US006749410B1

(12) United States Patent
Burch

(10) Patent No.: US 6,749,410 B1
(45) Date of Patent: Jun. 15, 2004

(54) PERISTALTIC PUMP HAVING A VARIABLE EFFECTIVE RADIAL LENGTH IMPELLER FOR METERING LIQUID CHEMICALS

(75) Inventor: Thomas B. Burch, Wilkesboro, NC (US)

(73) Assignee: Burch Company, Charlotte, NC (US)

( * ) Notice: Subject to any disclaimer, the term of this patent is extended or adjusted under 35 U.S.C. 154(b) by 0 days.

(21) Appl. No.: 10/070,941

(22) PCT Filed: Sep. 8, 2000

(86) PCT No.: PCT/US00/24818

§ 371 (c)(1),
(2), (4) Date: Mar. 8, 2002

(87) PCT Pub. No.: WO01/18394

PCT Pub. Date: Mar. 15, 2001

Related U.S. Application Data

(60) Provisional application No. 60/153,482, filed on Sep. 10, 1999.

(51) Int. Cl.[7] ..... F04B 43/12

(52) U.S. Cl. ..... 417/477.8; 474/478; 474/53; 474/521; 474/1

(58) Field of Search ..... 417/477.8, 474, 417/478, 53, 477.1, 521, 1

(56) References Cited

U.S. PATENT DOCUMENTS

| | | | | |
|---|---|---|---|---|
| 3,137,240 A | | 6/1964 | Hunt | |
| 4,043,712 A | * | 8/1977 | Azzolini | 417/477.8 |
| 4,184,815 A | * | 1/1980 | Casson et al. | 417/477.7 |
| 4,221,543 A | * | 9/1980 | Cosentino et al. | 417/22 |
| 4,805,088 A | * | 2/1989 | Cross et al. | 700/67 |
| 4,976,590 A | * | 12/1990 | Baldwin | 417/53 |
| 5,971,726 A | * | 10/1999 | Yoshida et al. | 417/477.1 |
| 6,036,459 A | * | 3/2000 | Robinson | 417/477.7 |
| 6,041,709 A | * | 3/2000 | Wells et al. | 101/366 |
| 6,494,693 B1 | * | 12/2002 | Sunden | 417/477.7 |

* cited by examiner

*Primary Examiner*—Justine R. Yu
*Assistant Examiner*—Emmanuel Sayoc
(74) *Attorney, Agent, or Firm*—Dougherty, Clements & Hofer

(57) ABSTRACT

A flexible apparatus for metering agricultural chemicals in a wet blade chemical distribution system consists of a modular peristaltic pump delivery apparatus (24) having an impeller (38) and a mounting bore (30) in a computer-controlled servomechanism that meters the correct amount of a wide variety of agricultural chemical regardless of equipment speed. It is especially well suited for easy field chemical change over and maintenance. A method for metering agricultural chemicals in a wet blade mower chemical distribution system is also disclosed

1 Claim, 10 Drawing Sheets

Section AA

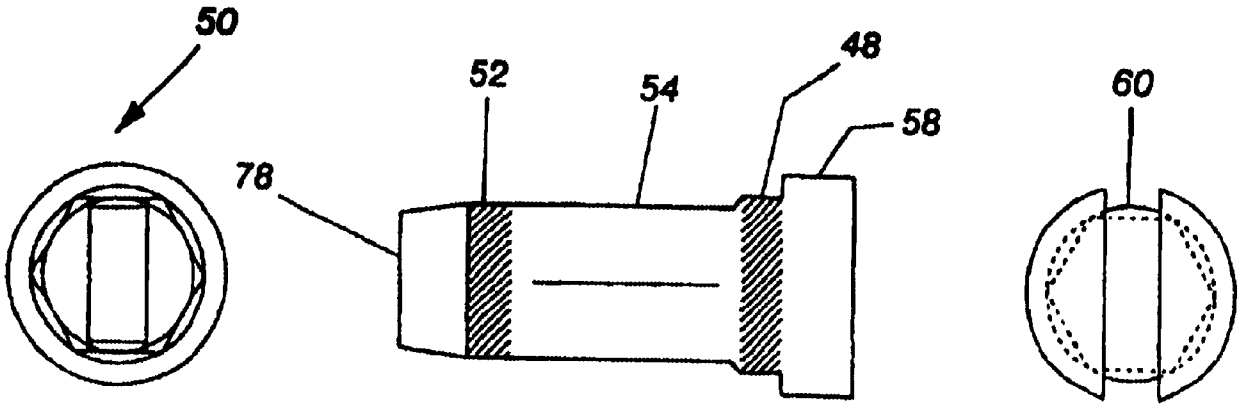
Fig.5
Fig.6
Fig.7
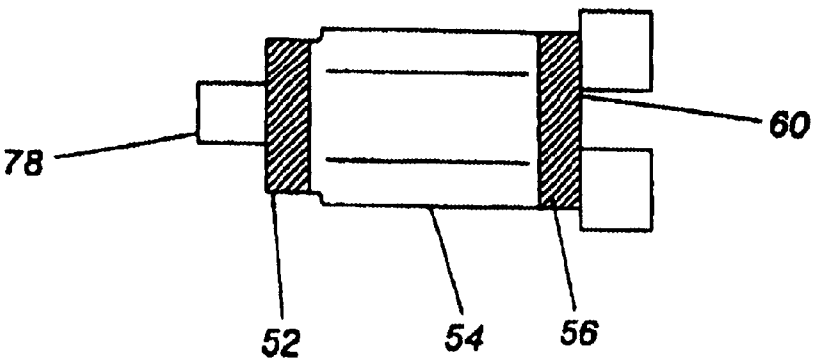
Fig.8

Section B

Section C

PERISTALTIC PUMP HAVING A VARIABLE EFFECTIVE RADIAL LENGTH IMPELLER FOR METERING LIQUID CHEMICALS

CROSS REFERENCE TO RELATED APPLICATIONS

This application claims the benefit of U.S. patent application Ser. No. 60/153,482, filed Sep. 10, 1999.

FIELD OF THE INVENTION

The invention relates to a method and apparatus for providing controlled rate distribution of liquids or liquid suspensions of fine solids for such agricultural purposes. Such purposes include fertilization and growth regulation of crops and eradication of unwanted plant life in a crop field.

BACKGROUND OF THE INVENTION

Wet blade agricultural liquid distribution systems rely on the rapid uptake of liquids that occurs in freshly cut plants at the wound. An order of magnitude reduction in the concentration of agricultural liquids is possible by applying the liquids essentially simultaneously with cutting. To accomplish this, liquid dispersal mechanisms have been incorporated into mowers. The advantages of this system are described in pending patent application PCT/US96/13362.

Peristaltic pumps are pumps of choice when flow rates are moderate and either corrosive, toxic or sterile liquids are pumped. The peristaltic pump utilizes the fact that the liquid to be pumped resides in a flexible tube. A length of tube is placed inside a rigid semi-cylinder. See FIG. 1. A rotating hub at the center of the cylinder drives a roller against the tube causing a flexure in the tube to travel in the direction in which the impeller hub rotates. For clarity, an impeller with a single roller is illustrated. As the flexure of the tube is relieved after the compression of the passing roller, a partial vacuum forms, drawing liquid from the intake side. The flow rate of liquid through the tube depends on the size and elastic properties of the tube, the hub rotation speed, the number of rollers, the viscosity of the fluid being pumped and the amount of tube compression. Tube compression depends on the size of the roller and the impeller arm dimension relative to the center of the cylinder.

This pumping system is preferable for use with vegetation control liquids because it can handle a variety of liquids and because human contact with some liquids is undesirable for safety reasons. If a conventional pumping system were used for both herbicides and fertilizers, extensive flushing of the system would be required between application of the two materials. With a peristaltic pump, the tubing associated with each chemical can be changed. The pump mechanism never directly contacts the pumped material. The part most subject to wear is the tubing, which is inexpensive to replace when necessary.

Field experience with this system resulted in the identification of several problems. Normally, peristaltic pumps run at a constant rate. In this agricultural application, the rate must change as the mower slows to turn or in response to variable terrain. A first solution of this problem was to replace the motor driving the peristaltic pump with a stepper motor. Step pulses drive the motor in harmony with the motion of the mower. With this improvement, wet blade distribution was practical. With varying materials, large changes in flow rates are often needed. To achieve integer multiples of a base flow rate for a given tube size, a plurality of tubes may be stacked in the cylinder. A tube coming from the source tank can be split into a manifold. The stack of tubes may be introduced into the cylinder. The number of tubes in the stack are limited by the height of the cylinder and roller. The output side of each tube can be distributed to appropriate nozzles or recombined with a manifold for material application.

Different size tubes can be used to achieve flow rates intermediate to the multiple tube manifold approach. A larger tube and compatible smaller diameter roller can be used to adjust flow rates.

Currently available peristaltic pumps are not designed for the field conditions encountered in the wet-blade distribution of agricultural chemicals. Even with the stepping motor regulator, there are problems in maintenance, set up and fine flow regulation. To make modifications in the field, the peristaltic pump is disassembled. The disassembly/reassembly process is problematic even for simple periodic maintenance like pump lubrication. Access to the pump mechanism requires removal of multiple machine-screws. Reassembly requires thumb screw adjustment of ferrules through which the tube is threaded. Too much pressure on the thumb screw causes the tube to constrict changing pump characteristics; too little pressure causes loss of control of the loop size within the pump. In addition, the screw mars the tube surface and if over tight, cuts the surface unacceptably. Disassembly to change tube size requires removing many small machine-screws.

OBJECTS OF THE INVENTION

The principal object of this invention is to provide an apparatus for metering agricultural chemicals in a wet blade distribution system that can be easily set up in the field to handle a wide variety of distribution rates and fluid viscosities.

Another object of this invention is to provide an apparatus that can react to various mower speed over the terrain.

Another object of this invention is to provide a modular peristaltic pump unit that is readily interchangeable.

A further object of this invention is to provide a peristaltic pump apparatus that is easy to maintain in the field.

Another object of this invention is to provide an improved method for metering agricultural chemicals in a wet blade distribution system.

SUMMARY OF THE INVENTION

The invention consists of a modular peristaltic pumping system that uses an associated microprocessor-based servomechanism for controlling fluid chemical distribution. The microprocessor stores: the number of modules attached, the roller axis setting, the elastomeric properties of the tubes used, the fluid properties of the material being pumped and the desired distribution rate for the agricultural objective. Real time inputs to the processor include the ground speed of the mower and the angular velocity of the impellers. From this data, the required impeller speed can be continuously calculated. This data and the characteristics of a DC motor are continuously used to calculate a data stream representing the needed motor speed. A digital-to-analog converter with appropriate buffering then drives the motor. The motor shaft drives the impellers in each pump module. The peristaltic modules are mounted on a frame. The motor is mounted to the frame. The motor shaft ends in a bit, similar to a screwdriver bit, that engages a mating slot in the first module. The shaft of the module engages the module's impeller and exits the module in a bit that is appropriate to engage a mating slot in the next module. Thus, modules can be ganged to permit an integer number of base distribution rates. Modules can be assembled on the frame without tools. Modules may be lubricated without tools. Modules can be disassembled without tools to change the tube or modify the effective impeller arm length.

Alternatively, a transmission may be provided between the motor shaft and the drive shaft of the peristaltic pump stack. The transmission may consist of a gear train or one or more pulleys and belts. In this case, the drive shaft of the transmission ends in a bit that engages a mating slot in the first module.

BRIEF DESCRIPTION OF THE DRAWINGS

The present invention may be better understood by reference to the following detailed description and to the accompanying drawings in which:

FIG. 5 is an end view of the shaft at the bit end.

FIG. 6 is a side view of the shaft, with the orientation of FIG. 5.

FIG. 7 is an end view of the shaft at the slot end.

FIG. 8 is a side view of the shaft, rotated 90° from FIGS. 5, 6, and 7.

DESCRIPTION OF THE PREFERRED EMBODIMENT

The present invention now will be described more fully hereinafter with reference to the accompanying drawings, in which a preferred embodiment of the invention is shown. This invention may, however, be embodied in many different forms and should not be construed as limited to the embodiment set forth herein; rather, this embodiment is provided so that this disclosure will be, thorough and complete, and will convey the scope of the invention fully to those skilled in the art. Like numbers refer to like elements throughout.

Figure 1:
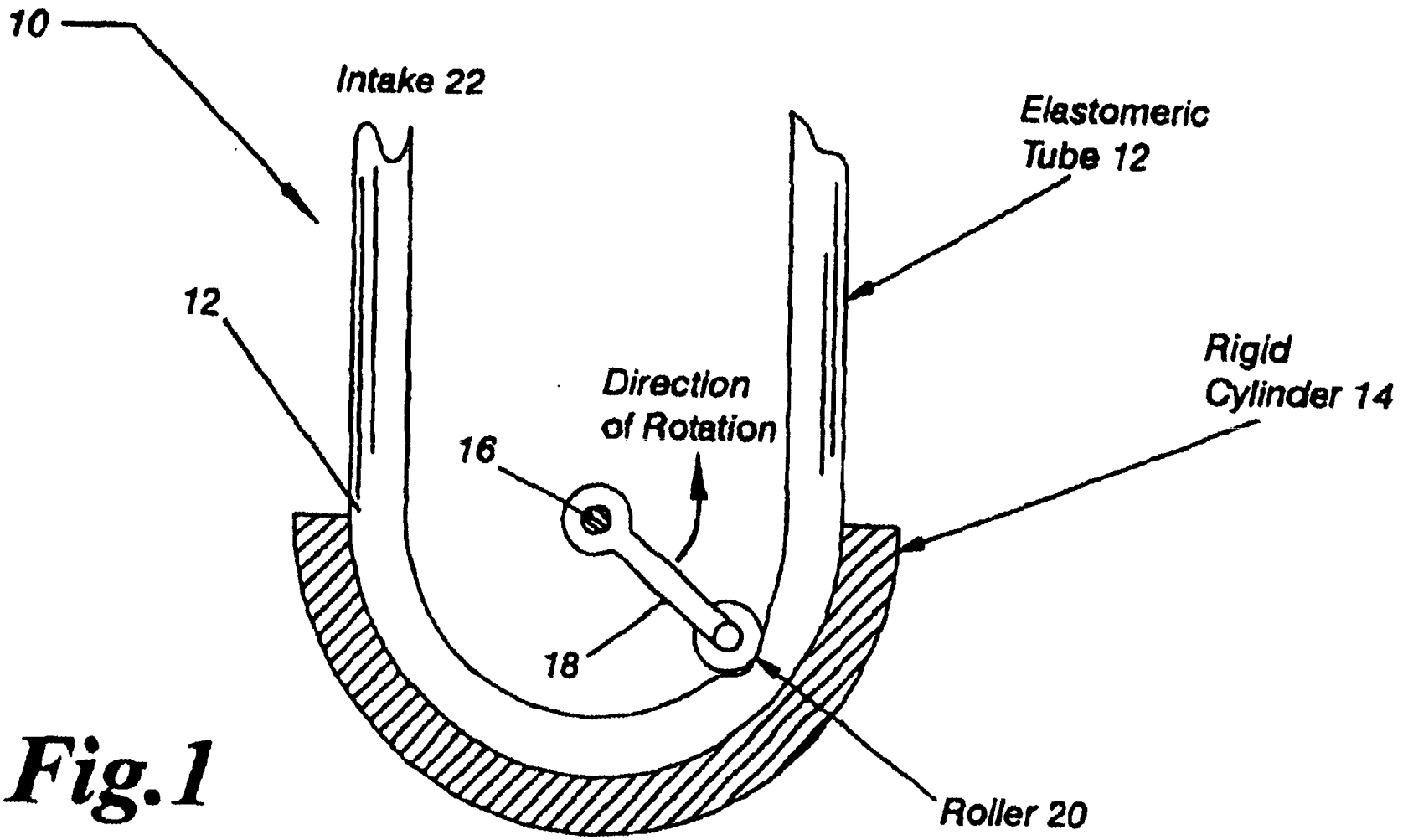
Fig. 1 (Prior Art)
FIG. 1 is a schematic cross-section of a prior art peristaltic pump for reference purposes.

FIG. 1 shows the basic elements of a peristaltic pump 10 as found in prior art. An elastomeric tube 12 is mounted against a rigid cylinder 14. The axis of the cylinder has a rotating hub 16 driving a radial arm 18. A roller 20 at the end of the arm has the appropriate dimension to compress the tube as the arm rotates. When the tube regains its shape after the passage of the roller, a pressure reduction occurs on the intake side 22. This pressure reduction results in the pumping action.

Figure 2:
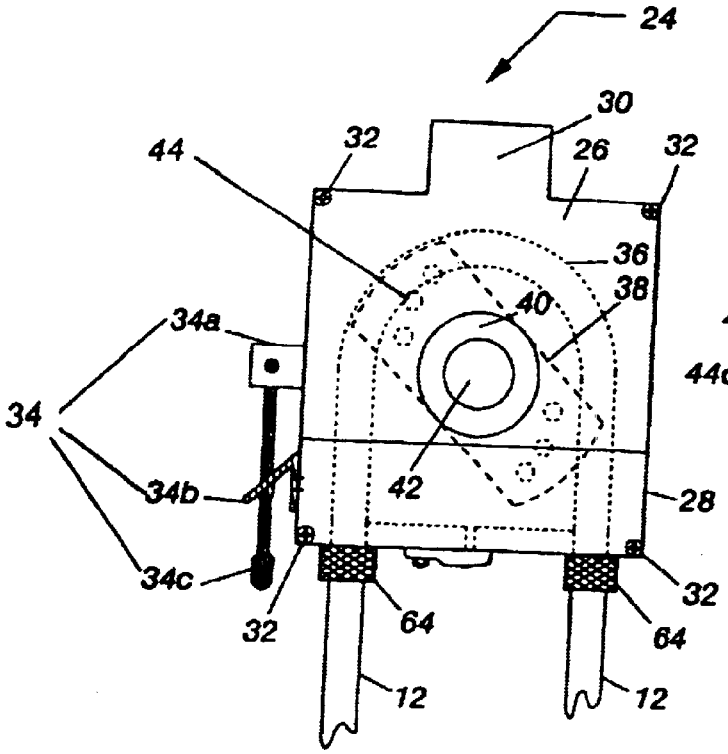
FIG. 2 is a side view face of the module without the shaft in place.

FIG. 2 shows the slot face of the module 24 housing the improved peristaltic pump of the invention. The housing consists of two pieces: the proximate housing part 26 and the distal housing part 28 that fit together like a clam shell. The proximate housing is shaped for mating to a frame, not shown and contains mounting bore 30. In the two outside corners of the proximate housing and the two outside corners of the distal housing, standoffs 32 are positioned to increase the stability of a multiple module stack when mounted. On the left side of the module is a keeper 34. The keeper 34 consists of a keeper mount 34*a* attached to the proximate housing, a receiver bracket 34*b* attached to the distal housing, and an elastic hasp 34*c*. The two housing parts are separated by grasping the hasp and stretching it until a tee-shaped thick portion of the hasp can clear the receiver bracket 34*b*. Once the left edges of the two housings are freed, they separate easily since the right edges are joined by any convenient tool-less means, for example, angled tongue and groove. Ferrules 64 slide over the tube 12 and into holes in the distal housing. The rigid cylinder 14 is indicated by hidden line 36. The tube is in contact with the proximate housing along this line. The impeller 38 is shown hidden by lines partly inside both housing parts and projected to the right. Bushing 40 surrounds the hole that receives the shaft.

The function provided by the elastic hasp is to give the operator the ability to disassemble a pump assembly in the field without tools and without handling small parts.

Figure 3:
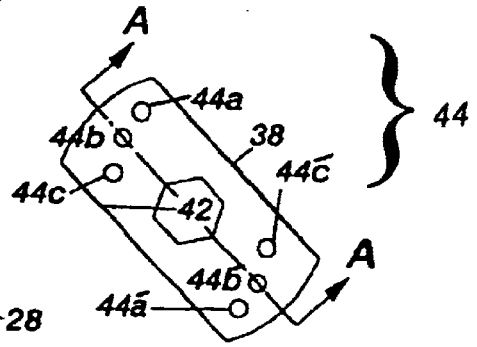
FIG. 3 is a side view of the impeller removed from the module.

FIG. 3 shows the impeller 38 that serves the purpose of the radial arm 18 in FIG. 1. The bore 42 in the impeller is hexagonal to ensure positive coupling from the bit that drives the shaft slot. There are six small holes, 44 in the impeller face to receive pins that mount the two rollers. Rollers are mounted in 44, which are comprised of 44*a*, 44*a*'; 44*b*, 44*b*' or 44*c*, 44*c*'. Mounting in 44*a*, 44*a*' provides the greatest tube compression. There is about a 30% change in effective length of the radial arm from position 44*a*, 44*a*' to 44*c*, 44*c*' illustrated here.

Figures 4A, 4B:
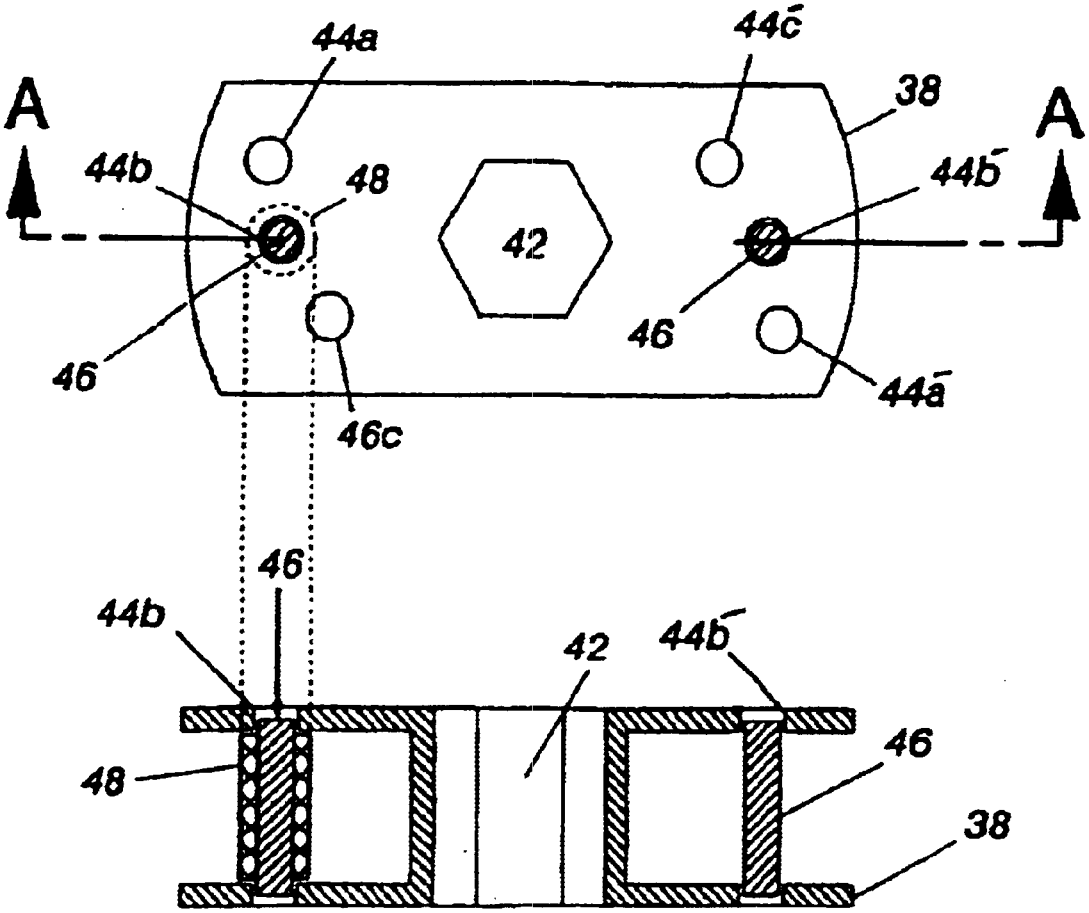
FIG. 4A is a side view of the impeller.
FIG. 4B is a cross-section of the impeller.

FIG. 4 shows a cross section AA of the impeller. Pins 46 (right side pin shown) mount, for example, in position 44*b*, 44*b*' (as shown) hold rollers 48 (left side roller shown). Alternatively, the pin and roller may be combined in a roller subassembly wherein the pin is spring-loaded and retracts into the assembly when the roller position is being changed instead of the separate parts illustrated here.

The function provided by an impeller pin positions 44 is the ability to flexibly set the pumping rate within a module. With the illustrated roller arrangement, the tube compression can be varied from about 36% to about 50% of the tube diameter.

FIGS. 5, 6, 7, and 8 illustrate the shaft 50 in four views. FIG. 5 is a view of the bit end of the shaft. The bit will engage the slot of the next module, if any, when multiple pumps are mounted on a frame. FIGS. 5, 6 and 8 show the bit 78 in three views. FIGS. 6 and 8 show the bearing surface 52 whose diameter approximately corresponds to the inscribed circle of the hexagonal cross section portion 54 of the impeller shaft 50. Circular bearing surface 56 has a diameter that approximately corresponds to the circle through the vertices of the hexagon. The shaft expands to a shoulder region 58 that contains slot 60. FIG. 7 is view of the slot end of the shaft, showing slot 60. FIG. 8 shows the shaft, rotated 90° from the view in FIG. 6.

The function provided is the ability to flexibly set base pumping rates by attaching a variable number of modules. The bit and slot uniquely enable the mower operator to remove and insert the modules on the module frame without tools. The shaft drives all modules at the same rotational speed. Other methods of ganging the modules do not offer the ability to remove a module from the middle of an assembly of modules. For example, a hexagonal-shaped bit and corresponding cavity would allow only the end module to be removed from the set.

FIG. 9 again shows the slot face of the pump module 24 but with the locations of section BB and CC indicated. In addition, lubrication aperture cover 62 is numbered.

Lubrication appropriate to the tube and roller materials may be sprayed with an aerosol sprayer or pumped with an oiler into the lubrication aperture 80 without removing the module from the frame.

Figures 9, 10, 11:
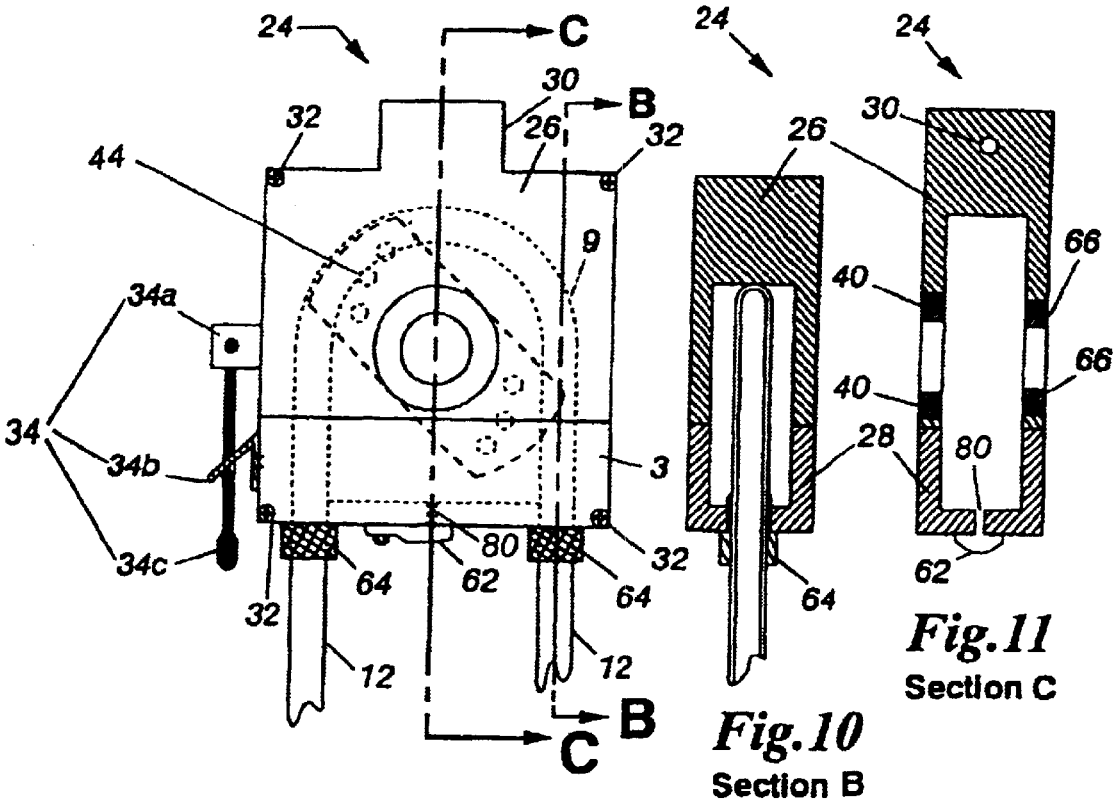
FIG. 9 is similar to FIG. 2 with the location of cross sections BB and CC added.
FIG. 10 is a cross-section of the module taken along line B—B of FIG. 9.
FIG. 11 is a cross-section of the module taken along line C—C of FIG. 9.

FIGS. 10 and 11 show cross sections of the module. FIG. 10 is the cross section through the tube 12 and ferrule 64. Note the section through the proximate housing 26 intersects a portion of the rigid cylinder. FIG. 11 is the cross section through the centerline of the module. This cross section shows the bushings 40 and 60 in a fine crosshatch. Note that the bore in bushing 40 is larger than the bore in bushing 60. Bushing 40 is the slot-side bushing and the shoulder of the shaft 58 rides on this bushing. The bore diameter is approximately the same as the circle that insects the vertices of the shaft's hexagonal cross section. The bore in bushing 60 is approximately the same as the included circle of the shaft's hexagonal cross section. FIG. 11 also illustrates the lubrication aperture 80 and the cross section of the lubrication aperture cover 62.

Figure 12:
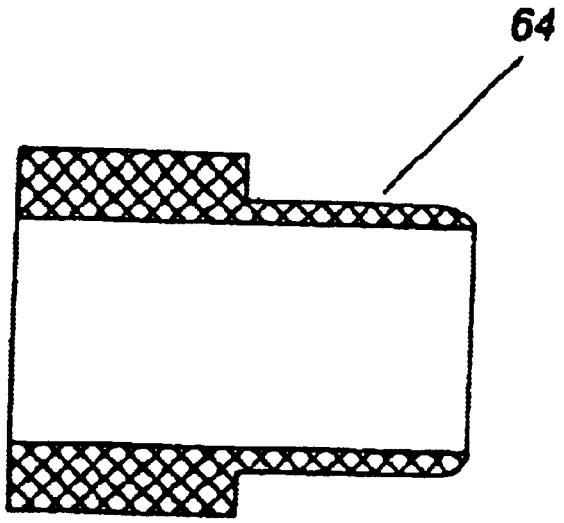
FIG. 12 is an enlarged cross-section of the ferrule shown in FIG. 10.
Figure 13:
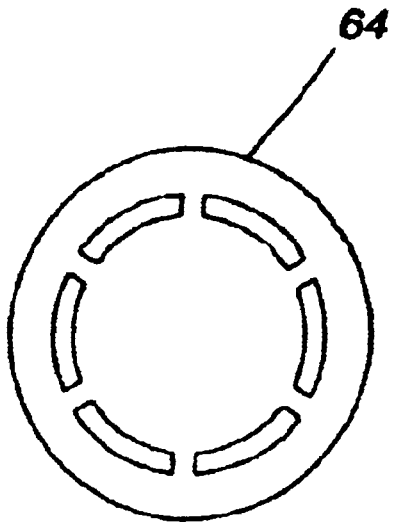
FIG. 13 is an end view of the ferrule.

FIGS. 12 and 13 present two views of ferrule 64. The ferrule has a section which is pliant. The ferrule slides over the elastomeric tube with the smaller diameter, a pliant portion toward the pump module. The ferrule slides into the corresponding bore in the housing. In doing so, pliant fingers in the ferrule press against the tube, securing it in place. FIG. 13 illustrate that wall of the distal diameter portion of the ferrule have notches every 60° along the circumference. These notches allow the ferrule to collapse around the tube somewhat, holding it firmly in place without machine-screws.

The function provided is the ability to change tubes in the field without tools. The length of the tube that rests against the rigid cylinder in the module can be easily fixed so that it stays in place during distribution of materials.

Figure 16:
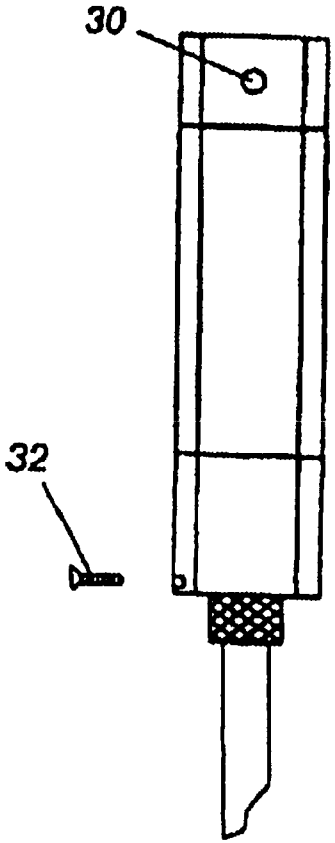
FIG. 16 is a bottom view of the module.
Figure 15:
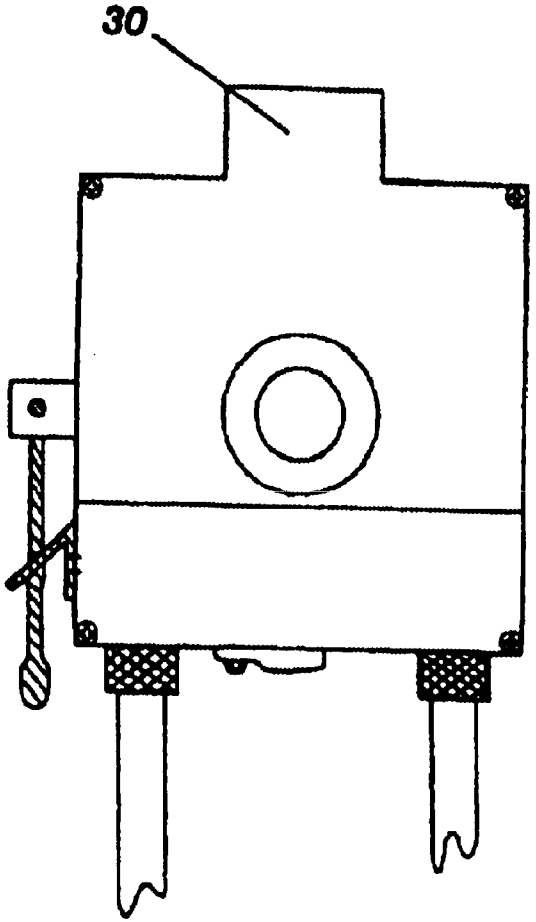
FIG. 15 is a side view of the module of the slot face showing without the shaft in place.
Figure 14:
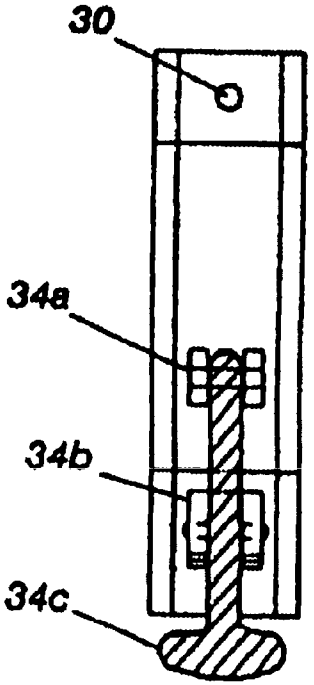
FIG. 14 is a top view of the module.

FIG. 14 shows the housing of the improved pump from the top. The tube and ferrules have been omitted in order to more clearly present the hasp arrangement that permits the housing to be serviced in the field without tools. The elastic hasp 34*c* engages the keeper 34*b* where it widens. The hasp pivots in keeper mount 34*a*. The hasp 34*c* is operated by grasping the handle, the tee-shaped portion at the bottom and stretching the it until the wide portion clears the keeper 34*b*. FIG. 15 is a view of the outside of the slot side of the pump module given to reference FIGS. 14 and 16. FIG. 16 is a view of the bottom of the module with a preferred method of minimizing mechanical movement of mounted modules, stand off 32 illustrated. In this embodiment, stand off 32 is a standard machine-screw. The space magnitude is determined by the length of the standard screw and the depth of the threaded cavity in the module housing.

Figure 17:
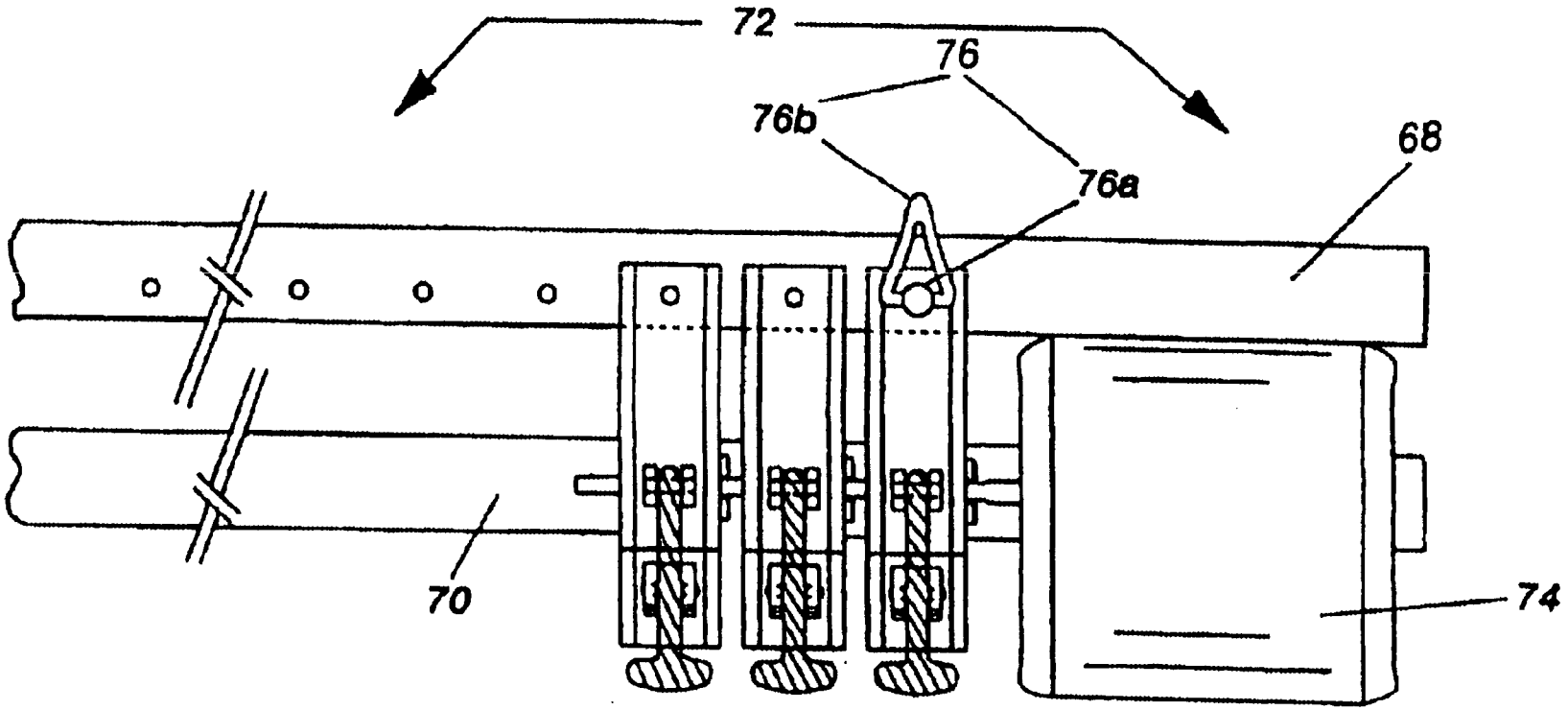
FIG. 17 is a top view of an assembly of three modules mounted on a frame with the motor in place.

FIG. 17 shows the angle rail 68 and channel 70 that form the critical elements of the mounting frame 72. Angle rail 68 has holes drilled on appropriate centers for aligning with the pumping modules. The angle rail 68, channel 70 and DC motor 74 are mounted to frame components that are not shown. The DC motor has a shaft encoder, not shown. Three modules are shown in position on angle rail 68. The mounting bores 30 are positioned over the corresponding hole in the angle rail 68. The rightmost module also illustrates the mounting snap assembly 76 . The snap assembly 76 consists of a pin 76*a* with the diameter consistent with mounting bore 30, and a snap 76*b*. The head of the pin 76*a* has a larger diameter so that it will seat on the pump module. A U-shaped snap can pivot in the head of the pin 76*a*. The delta-shaped snap 76*b*, shown in FIG. 17, connection gives way to the U-shape in the orthogonal view as seen in FIG. 18.

The function provided by a pin-snap mechanism 76 for precise alignment of modules is the ability for the operator to accurately position a module on a simple frame in juxtaposition to leading and trailing modules in such a way that drive coupling is assured.

Figure 18:
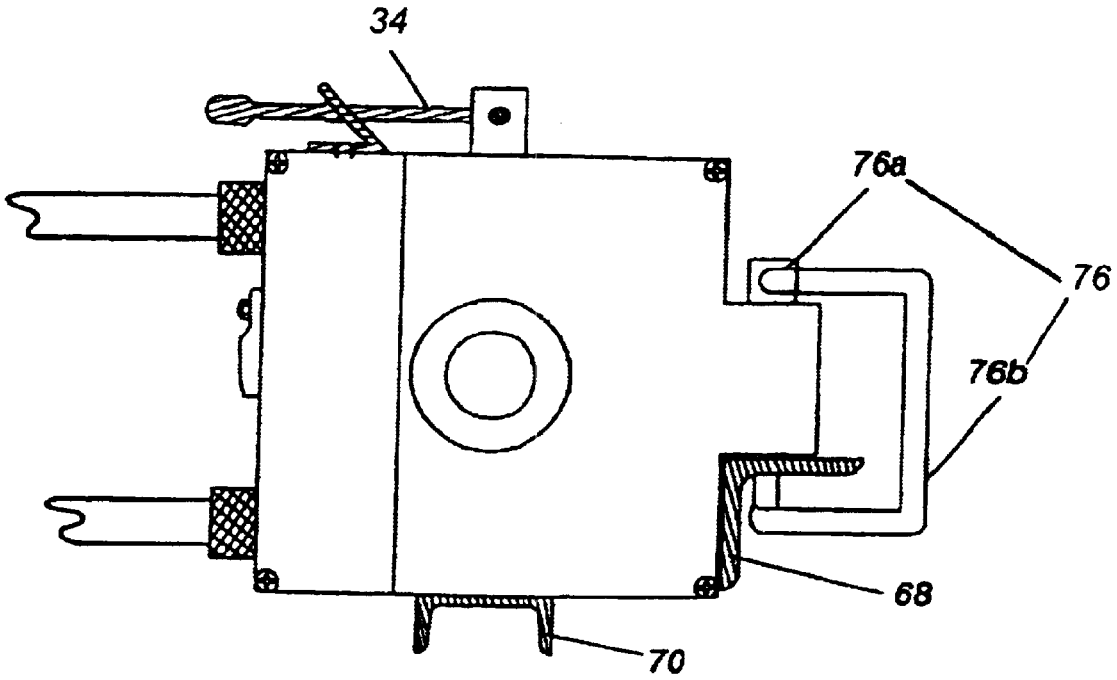
FIG. 18 is a side view of the slot face of the module resting on and attached to a frame.

FIG. 18 shows the slot face of the module with the module resting on the angle 68 and the channel 70. The U-shaped portion of the snap is easily seen in this view.

Figure 19:
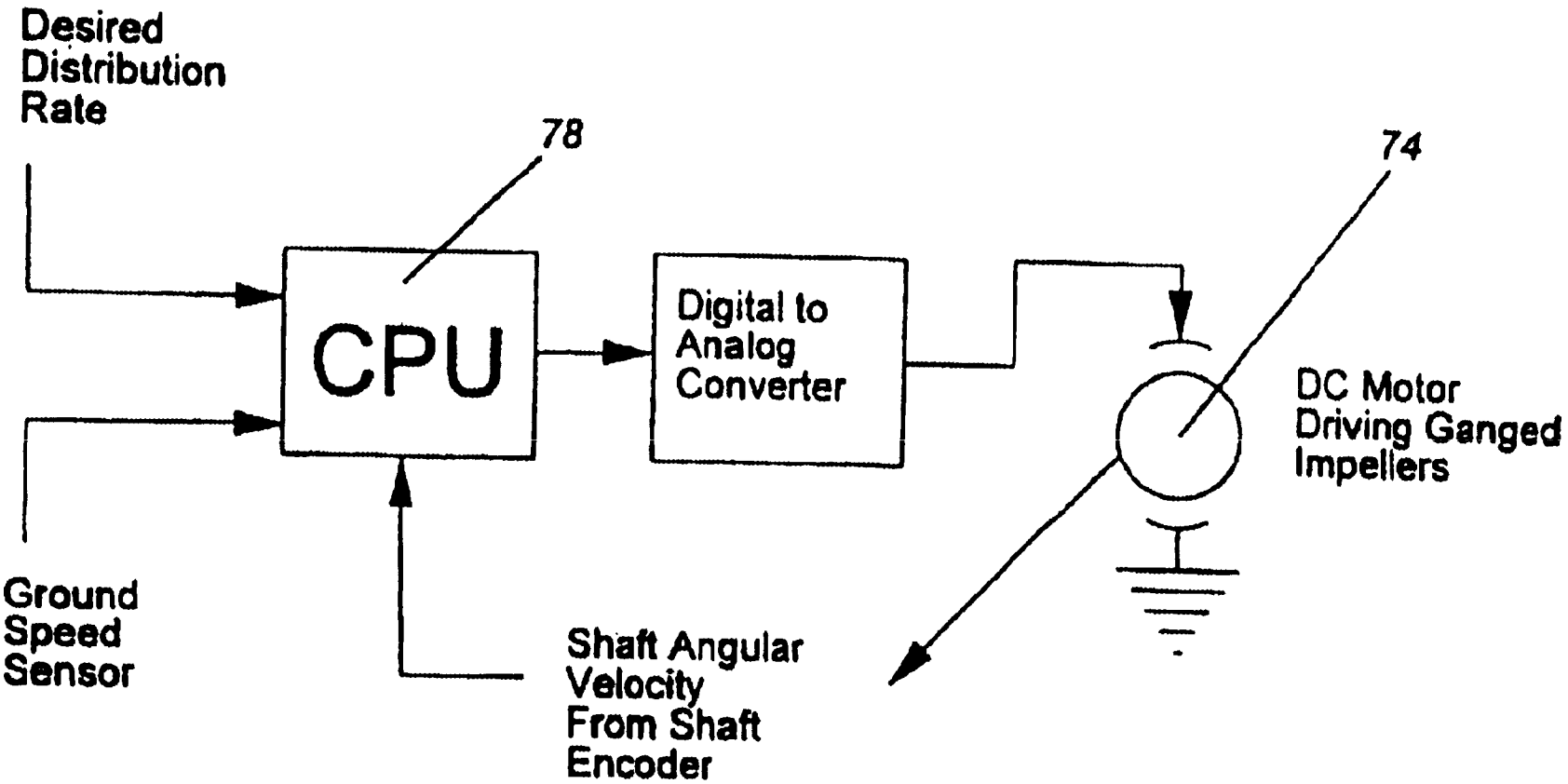
FIG. 19 is a schematic diagram of a computer-based servomechanism for controlling the pumping rate of the invented modules.

FIG. 19 is a diagram of the servomechanism. Software running on the CPU 78 calculates the appropriate voltage to drive the DC motor 74, based on ground speed, loaded details concerning the agricultural objective and the actual shaft velocity of the motor. The response times and gain of this loop are engineered, by conventional means, to assure stability so the motor speed will not hunt, continuously change without the change of any input.

The continuous servomechanism control, FIG. 19, is superior to the unimproved stepper motor control because the pumping action results from the elastic recovery of the tube just released from roller pressure. The unimproved stepper might advance the impeller 1° every minute. During the minute, the impeller is stationary. In the improved system, the motor can run at 1° per minute. The elastic recovery is monotonic (although not linear at very low speeds) and continuous. In the unimproved stepper realization, the distribution rate becomes granular, available only at discrete rates particularly at slow rates. In these systems slow rates are extremely important as the mower slows to reverse direction or to accommodate terrain conditions.

Since the servomechanism is microcomputer-based, parameters that vary only at setup time can be easily input and retained for the duration of the setup. Parameters can be input by the mower operator by keypad and/or captured in other well-known ways. For example, the viscosity-temperature profile of a number of materials can be retained in the system. The operator would need only to key in the identification number of the materials. Alternatively, the number can be entered by scanning a bar code on the material container with a wand attached to the computer.

Field set up of integer-multiples of base distribution rates are achieved by the modular pumping package, FIGS. 17 and 18.

In a specific agricultural operation, the fluid to be dispensed and a desired distribution rate is specified be the agricultural objective (a growth rate, fertilization need, herbicidal need etc.). Referring to FIG. 17, field set up proceeds as follows:

1. Referring also to FIG. 9, after removing the module from the frame 72 by removing the pin-snap 76, the housing parts 26 and 28 are separated by grasping the elastic hasp 34*c* and stretching it until it clears the receiver 34*b*. The two pieces easily separate.
2. The existing pumping tube 12 is removed by sliding the shaft 50 out of the impeller module 24 and removing the impeller. The ferrules 64 are slid off the tube and retained, if desired. The old tube is removed.
3. Also referring to FIG. 4, based on the agricultural requirement, the rollers are reset if necessary by removing the roller retainer pins 46, repositioning the rollers and replacing the pins in the impeller.
4. The new tube is fed through the holes in the smaller housing and the ferrules are slid over the appropriate ends of the tube. The impeller is placed in the loop of the tube and secured into module 24 by inserting the shaft, bit end first through the larger bushing first. Note: It will not go in any other way.
5. The housing parts are joined with the elastic hasp 34*c*.
6. The ferrules 64 are adjusted to assure that the tube loop 12 rests without binding in the cylindrical section of the proximate housing 9.
7. The reassembled module is placed on the rails of the frame 72. Rotating the shaft may be necessary so that the bit and slot align with the other modules already in place.
8. The pin-snap 76 is then inserted into the mating hole in the frame. This insures appropriate spacing. The snap is closed.

SUMMARY OF THE ACHIEVEMENT OF THE OBJECTS OF THE INVENTION

From the foregoing, it is readily apparent that I have invented a method and an apparatus for metering agricultural chemicals in a wet blade distribution system that can be easily set up in the field to handle a wide variety of distribution rates, fluid viscosities, and mower speed over the terrain, moreover, the method and apparatus provides a modular peristaltic pump unit that is readily interchangeable and easy to maintain in the field.

In the drawings and specification, there have been disclosed typical preferred embodiments of the invention and, although specific terms are employed, they are used in a generic and descriptive sense only and not for purpose of limitation, the scope of the invention being set forth in the following claims.

What is claimed is:

1. A chemical metering system operatively coupled with a mobile agricultural equipment unit, where said mobile agricultural equipment unit is a mower, said chemical metering system comprising:

a drive motor having a drive shaft;

at least one metering device, said metering device being coupled to said drive shaft of said drive motor;

a processor for controlling the drive shaft velocity based on a ground speed of the agricultural equipment, the drive shaft velocity and a pre-determined chemical distribution rate;

a signal converter electrically interconnecting said processor and said drive motor;

a ground speed sensor electrically connected to said processor; and means for measuring drive shaft velocity electrically connected to said processor.

* * * * *